United States Patent [19]

Kelly et al.

[11] Patent Number: 4,657,785

[45] Date of Patent: Apr. 14, 1987

[54] USE OF BENZO AND TOLYLTRIAZOLE AS COPPER CORROSION INHIBITORS FOR BOILER CONDENSATE SYSTEMS

[75] Inventors: John A. Kelly, Woodridge; David A. Grattan, LaGrange Highlands; Alfred W. Oberhofer, Downers Grove, all of Ill.

[73] Assignee: Nalco Chemical Company, Oak Brook, Ill.

[21] Appl. No.: 807,639

[22] Filed: Dec. 11, 1985

[51] Int. Cl.[4] ..... C04B 9/02; C23C 16/00; C23F 11/04

[52] U.S. Cl. ..... 427/255.6; 106/14.15; 106/14.16; 422/11; 422/16

[58] Field of Search ..... 106/14.15, 14.16; 427/255.6; 422/11, 16

[56] References Cited

U.S. PATENT DOCUMENTS

| | | | |
|---|---|---|---|
| 4,292,190 | 9/1981 | Davis et al. | 106/14.16 X |
| 4,350,606 | 9/1982 | Cuisia et al. | 106/14.15 X |
| 4,406,811 | 9/1983 | Christensen et al. | 106/14.15 X |

*Primary Examiner*—Michael R. Lusignan

*Attorney, Agent, or Firm*—John G. Premo; Donald G. Epple; Anthony L. Cupoli

[57] ABSTRACT

The use of benzo and/or tolyltriazole alone or in combination with neutralizing and filming amines to reduce copper corrosion in boiler condensate systems by feeding the mixture into the main steamheaders.

2 Claims, No Drawings

USE OF BENZO AND TOLYLTRIAZOLE AS COPPER CORROSION INHIBITORS FOR BOILER CONDENSATE SYSTEMS

ADVANTAGES OF THE INVENTION

Copper corrosion in condensate systems is caused mainly by the presence of dissolved ammonia and oxygen. Current state-of-the-art condensate treatment programs (neutralizing and filming amines) do not inhibit copper corrosion in these systems. Consequently, a research program was undertaken to develop a copper condensate corrosion inhibitor. Benzotriazole (BT) and tolyltriazole (TT) are known copper corrosion inhibitors and are extensively used throughout industry.

These compounds react with copper to form an insoluble copper complex or film on the metal surface which acts as a corrosion barrier. The copper complex is reported to be stable up to 536° F. Review of the literature showed no reports of the use of BT or TT as copper corrosion inhibitors for boiler condensate systems.

EVALUATION OF THE INVENTION

Experimental Procedure used to Determine V/L Ratios[1] of BT and TT When Fed to the Steamheader Aqueous solutions containing TT or BT, alone or in the presence of neutralizing amines, were continuously injected into the steamheader of the research boiler operating at 600 or 1000 psig. The treated steam was passed through a heat exchanger where it was partially condensed (initial condensate). The initial condensate was continuously removed from the exchanger. The steam exiting this heat exchanger was passed through a second exchanger where it was fully condensed (final condensate). The inhibitor concentration in the initial and final condensate was determined using the Hach analytical procedure for analyzing for TT and BT. The V/L ratios were calculated based on these concentrations. Table I lists the results.

[1]Vapor Liquid distribution ratio.

TABLE I

| | V/L Ratio of TT and BT when Injected into the Steamheader* | | | |
|---|---|---|---|---|
| Inhibitor | Boiler Pressure (psig) | PPM in Initial Condensate | PPM in Final Condensate | V/L |
| BT | 600 | 11.45 | 4.63 | 0.40 |
| BT | 1000 | 7.80 | 4.40 | 0.56 |
| TT | 600 | 10.80 | 4.45 | 0.41 |
| TT | 1000 | 7.80 | 4.40 | 0.56 |
| TT (Na—salt) | 600 | 6.50 | 2.01 | 0.31 |
| TT** | 600 | 8.20 | 3.40 | 0.42 |
| TT*** | 600 | 9.70 | 4.20 | 0.43 |
| condensate filming amine | 600 | 2.55 | 1.45 | 0.57 |

*The V/L ratio found for TT and BT at atmospheric pressure was 0.005 and 0.003 respectively. Injection of TT or BT into the feedwater of a boiler operating at 1000 psig produced a V/L ratio equal to 0.01.
**This solution also contained DEAE (diethylamino ethanol).
***This solution also contained morpholine.

SALT SPRAY TARNISH TEST

Background: When Cu metal is sprayed with a sodium chloride solution and allowed to stand in a humidification chamber for a given period of time, it will tarnish (corrode). In the case where Cu has been treated with TT or BT prior to spraying it, the metal does not tarnish. The reason for this is that these inhibitors react with the Cu surface to form a film barrier which protects the surface from corrosion. This test was designed to detect the presence of TT and BT on Cu coupons after immersing them in aqueous solutions containing the inhibitor in the presence of $NH_3$ or neutralizing amines. If the coupons did not tarnish, it meant TT or BT reacted with the Cu surface and was laying down a protective layer and reducing the corrosion induced by $NH_3$ or the amines. In certain cases where the concentration of $NH_3$ or the amine were relatively high, the coupons were black in appearance even before salt spraying. However, under similar condition, the appearance of the coupons in the inhibited solution appeared unaltered.

Test Procedure A:

Freshly sandblasted Cu coupons were ultrasonically cleaned, degreased (acetone) and dried prior to testing. The coupons were immersed for 3 hours at 62° C. in 250 ml aqueous $NH_3$ solutions (5 to 31.5 ppm) treated with or without TT or BT (1 to 6 ppm). Afterwards the coupons were removed from solution, rinsed with DI $H_2O$, then sprayed with a 1.5% NaCl solution and hung in a humidification chamber containing the salt solution. After 16 hours at room temperature, the coupons were removed, rinsed with DI $H_2O$, followed by acetone, and then air dried. The dried coupons were inspected for degree of tarnishing. Those coupons immersed in the TT or BT solutions were significantly less tarnished or not tarnished at all.

Test Procedure B:

A solution of TT was injected into 1000 psig steam such that the concentration of the inhibitor in the steam was approximately 3.0 ppm. The treated steam was passed through a cooler to fully condense it. The resulting condensate (90°–120° F.) was passed through a section of Cu tubing on a continuous basis. After 3 hours, a section of this tubing was taken and cut open to expose the interior surface. It was then subjected to the salt spray tarnish test. The results showed that the interior of the tube was significantly less tarnished than the exterior. This indicated that TT's inhibitory activity was not destroyed by injecting it into high temperature and pressure steam. When this test was run without TT treated steam, the interior of the tube was much more tarnished.

TABLE II

| | Copper Coupon Corrosion Results at Room Temperature* | | |
|---|---|---|---|
| TT Dosage (PPM) | PPM NH | Average wt. loss (mg) | % Inhibition |
| 0 | 6.3 | 5.72 | — |
| 0 | 31.5 | 9.57 | — |
| 1.0 | 6.3 | 1.52 | 73 |
| 1.0 | 31.5 | 2.92 | 70 |
| 6.0 | 6.3 | 1.72 | 70 |
| 6.0 | 31.5 | 2.62 | 73 |

*Cu coupons were freshly sandblasted then ultrasonically cleaned in methanol, acetone rinsed, dried and weighed prior to being suspended in 250 ml of the above solutions for 72 hours. Afterwards, the coupons were acid cleaned (70% inhibited HCl), dried and reweighed. The weight loss listed above has been corrected for the amount lost due to the cleaning process itself.

TABLE III

| Examples of Increased Solubility of TT and BT in Aqueous Amine Solutions | | |
|---|---|---|
| Solution 1 | Solution 2 | Solution 3 |
| 15.0 g MEA[1] | 40 g Morpholine | 40 g DEAE |

TABLE III-continued

| Examples of Increased Solubility of TT and BT in Aqueous Amine Solutions | | |
|---|---|---|
| Solution 1 | Solution 2 | Solution 3 |
| 15.0 g MOPA[2]<br>5.0 g TT<br>65 g DDI $H_2O$ | 10 g TT<br>50 g DI $H_20$ | 10 g BT<br>50 g DI $H_2O$ |

[1]Monoethanol amine
[2]Methoxypropylamine

DISCUSSION

The low V/L ratios observed for BT and TT in these experiments is caused by the fact that they are converted to their sodium salt forms in the boiler due to the high pH of boiler water. Thus to be effective condensate inhibitors, BT and TT must be fed to the main steamheaders. Results from experiments where BT and TT were injected into 1000 psig steam indicated these compounds were stable, and their V/L ratio had increased to 0.5, which is 50 times higher than observed from our feedwater experiments. The V/L ratio of 0.5 is similar or higher than currently used condensate filming amines. Subsequently, BT and TT should be transported through the condensate system by a mechanism similar to that for the filming amines.

Another important aspect of this invention is that BT and TT were found to be compatible with neutralizing amine formulations. In fact, BT and TT exhibited higher solubilities in aqueous amine solutions (20–40%) than in water itself. BT and TT are soluble in water at 25° C. to the extent of 1.98 and 0.55%, respectively. Depending on the amine formulation, solutions containing up to 10%, or greater, by weight of BT or TT were possible. Since these copper inhibitors are compatible with current condensate treatments, it is an advantage because only one product would have to be fed to control both iron and copper corrosion.

An additional advantage of using BT and TT is that they react with soluble copper ions in the returned condensate to produce insoluble complexes which can be either filtered out by the condensate polishers or serve as a mechanism to help transport copper through the boiler.

It should be noted that the sodium form of these compounds can be substituted in place of BT and TT. But this is less desirable from the standpoint that it will increase the sodium concentration in the steam and possibly increase the conductivity of the returned condensate.

As indicated, an important concept of the invention resides in combining either the benzo or tolyltriazoles with either neutralizing or film-forming amines.

The neutralizing amines are well known. Typically, such amines are such compounds as morpholine, cyclohexylamine, diethylamino ethanol (DEAE), methoxypropylamine (MOPA), dimethyl isopropanol amine (DMIPA), aminomethyl propanol (AMP), and monoethanol amine (MEA) or blends thereof.

In the case of film-forming amines, these compounds are illustrated by the well known film-forming amine, octadecylamine.

The most important concept of the invention resides in feeding the triazoles to the steam headers. Otherwise, they are not effective in preventing copper corrosion in condensate systems.

While the word, "copper corrosion," is used in describing the invention, copper includes not only copper metal but its well known alloys such as brass, bronze, and admiralty metal.

The amount of BT or TT used in the invention to protect copper and its alloys need be but a few ppm in the steam being treated. Thus, amounts as little as 0.1 up to as much as 50 ppm by weight may be used. Preferably, the range is 0.5 to 10 ppm.

What is claimed is:

1. A method of reducing copper corrosion in a boiler condensate system operating at a pressure of at least 600 psi, which contains at least one steam header, which comprises feeding into said steam header a corrosion inhibiting amount of a triazole from the group consisting of benzotriazole, tolyltriazole or their alkali metal salts, whereby said triazoles are mixed with said steam and transported through said system to treat the copper surface to inhibit corrosion.

2. The method of claim 1 where the triazoles are used in combination with either neutralizing or film-forming amines.

* * * * *